United States Patent [19]

Shemitz

[11] 4,054,793

[45] Oct. 18, 1977

[54] LIGHTING SYSTEM

[75] Inventor: Sylvan R. Shemitz, Woodbridge, Conn.

[73] Assignee: Sylvan R. Shemitz Associates, Inc., New Haven, Conn.

[21] Appl. No.: 581,374

[22] Filed: May 27, 1975

Related U.S. Application Data

[63] Continuation of Ser. No. 390,570, Aug. 22, 1973, abandoned.

[51] Int. Cl. ..... F21v 5/02

[52] U.S. Cl. ..... 362/127; 312/223; 362/224; 362/330

[58] Field of Search ..... 240/9, 25, 41.3, 51.11, 240/73 LD, 78 LK, 78 LD, 93, 103 R, 106 R, 106.1, 4; 312/223

[56] References Cited

U.S. PATENT DOCUMENTS

| | | | |
|---|---|---|---|
| 3,222,515 | 12/1965 | Orr | 240/106 R |
| 3,258,590 | 6/1966 | Goodbar | 240/106 R |
| 3,265,887 | 8/1966 | Wince | 240/106 R |
| 3,389,246 | 6/1968 | Shemitz | 240/9 X |
| 3,557,359 | 1/1971 | Meyer | 240/51.11 X |
| 3,647,148 | 3/1972 | Wince | 240/106 R |
| 3,721,818 | 3/1973 | Stahlhut | 240/51.11 R |

FOREIGN PATENT DOCUMENTS

| | | | |
|---|---|---|---|
| 689,568 | 6/1964 | Canada | 240/106 R |

*Primary Examiner*—L. T. Hix
*Assistant Examiner*—Alan Mathews
*Attorney, Agent, or Firm*—DeLio and Montgomery

[57] ABSTRACT

A desk level work area and its immediate environment are lighted with reduced or eliminated glare and veiling reflections from the task, by a lighting fixture mounted between seated eye height and standing eye height. The lighting fixture comprises an elongated housing, a light source within the housing providing illumination longitudinally of the housing, and a refractor plate capable of distributing luminous flux from the light source in a bat wing configuration. The plate is mounted on the housing such that the bat wing configuration of the luminous flux is directed essentially to the right and left of a viewer transversely facing the light source.

9 Claims, 12 Drawing Figures

LIGHTING SYSTEM

This is a continuation of application Ser. No. 390,570, filed Aug. 22, 1973, now abandoned.

BACKGROUND OF THE INVENTION

This invention relates to lighting fixtures and systems, and particularly to lighting systems for lighting work areas under cabinets or on and around desk surfaces in offices and the like.

From the standpoint of pleasing appearance as well as good lighting of work areas, ceiling and wall fixtures in business offices, factories and homes are rapidly being replaced by lighting fixtures which are mounted on or integrated into cabinets, bookshelves, and facia panels of various types. Such constructions bring the light source closer to the task and reduce or eliminate direct glare by hiding the light source from view and by controlling the light with suitable lenses, refractors, reflectors, baffles, louvers and the like. The light can thereby be directed downwardly and upwardly, the latter if lighting of the immediate environment above the work area is also required. When incorporated into office partitions, such lighting fixtures readily adapt to almost any work area. Systems of the foregoing types are described in applicant's U.S. Pat. No. 3,389,246, issued June 18, 1968.

Refractor plates of specialized design are now available which will reduce or eliminate both direct and reflected glare from a light source. Reflected glare is also known as veiling reflection and results from reflections from a task and the background of the task. For example, light-colored desk surfaces, writing paper thereon and light colored backgrounds reflect desirable light, but if the task (e.g., pencil writing) also reflects light to the viewer, the contrast between the task and its immediate background is reduced. It is this reduction of contrast which makes seeing difficult.

Direct glare can be eliminated by baffles, shields, refractors and reflectors which cut off direct view of the lighting source. As for the elimination of veiling reflections, when their source is light emitted downward from a zone located above and slightly in front of the task area, refractor plates have been developed which refract or redirect the light. This refraction can be visualized in terms of the photometric curves showing relative candlepower distribution of the luminous flux. These curves take the form of a half bat wing shape, or a full bat wing shape if all of the luminous flux below and adjacent to the plane of the refractor is analyzed. The bat wing configurations represent luminous flux patterns and indicate the direction and distribution of the flux.

Typical of refractor plates which distribute luminous flux from a light source in a bat wing configuration are the plates described in U.S. Pat. No. 3,258,590 — Goodbar and the commercially available refractor plate known as "K-S-H 701 Lensmatic" lens, K-S-H, Inc., St. Louis, Missouri. While such refractor plates are known to distribute light in the useful bat wing configuration, their use has been defective in that they have not been task oriented, thereby resulting in direct glare and veiling reflections.

OBJECTS AND SUMMARY

Accordingly, an object of the invention is to provide a new and improved lighting fixture and system whereby direct glare and veiling reflections are substantially eliminated and good illumination is achieved, not only of the task but also the environment thereof, such as apron areas, contiguous working surfaces, and the like.

Another object is to provide a new and improved lighting fixture which may be conveniently incorporated into office partitions, cabinets, and the like or incorporated or located on or adjacent to work surfaces with greatly improved appearance and lighting effectiveness.

These and other objects, features and advantages of the invention will be apparent from the specification which follows.

In summary outline, the objects of the invention are achieved by a lighting fixture comprising an elongated housing, a light source within the housing providing illumination longitudinally therefrom, and a refractor plate which is capable of distributing luminous flux from the light source in a bat wing configuration. The refractor plate is mounted with respect to the light source such that the bat wing configuration of luminous flux is directed essentially to the right and left of a viewer who is transversely facing the elongated light source. The top portion of the elongated housing may be open or openable, if desired, so as to direct luminous flux upwardly to the envirnoment.

The invention accordingly comprises the features of construction, combination of elements, and arrangements of parts which will be exemplified in the construction hereinafter set forth, and the scope of the invention will be indicated in the claims.

DETAILED DESCRIPTION

For a fuller understanding of the nature and objects of the invention, reference is had to the following description taken in conjunction with the accompanying drawings, in which.

Figure 1:
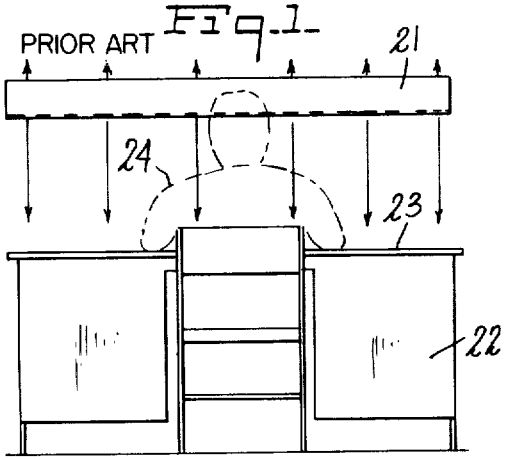
Fig. 1 PRIOR ART
FIG. 1 is a partly diagrammatic, elevational view of a work station utilizing a known longitudinal lighting fixture.
Figure 2:
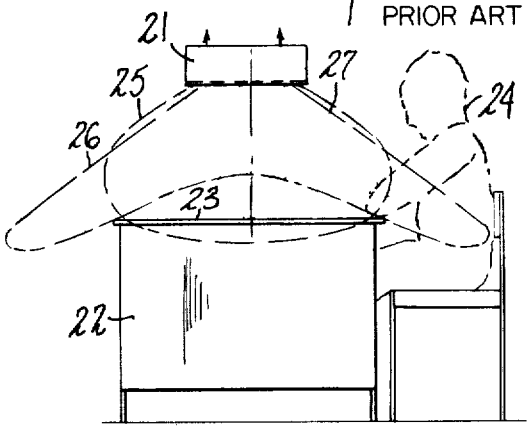
Fig. 2 PRIOR ART
FIG. 2 is a side view of the work station of FIG. 1.

With reference to FIGS. 1 and 2, a typical lighting fixture comprises a housing 21 mounted above a work station such as a desk 22 so that the task viewed by a worker 24 will be illuminated. Such housings 21 are known to perform best when their mounting heights are in the range of about seated eye height to about standing eye height. As indicated in FIG. 1, the lighting fixture illuminates not only the task 23 but also, if suitable openings are provided in the top portion of the housing 21, it can illuminate the environment of the work station such as the ceilings and walls adjacent the work station. The light source itself is masked from view by the housing 21.

The side view of FIG. 2 illustrates two known photometric configurations of luminous flux provided by lighting fixtures. The most common configuration is the spherical configuration 25. This configuration indicates that light is thrown directly onto the task 23. The effect of configuration 25 is to clearly illuminate the task but with considerable loss of contrast due to veiling reflections from the task to the eyes of the worker. In other prior art applications, refractor plates have been employed in ceiling fixtures which spread the luminous flux transversely of the longitudinal axis of the light source in the configuration of a generally bat wing photometric pattern.

Figure 3:
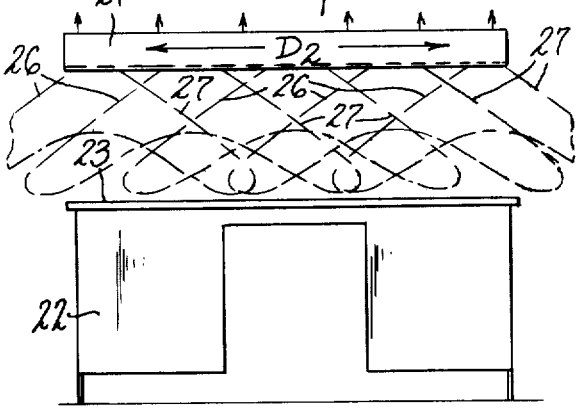
FIG. 3 is a view similar to the view of FIG. 1 but utilizing a lighting fixture of the invention.
Figure 4:
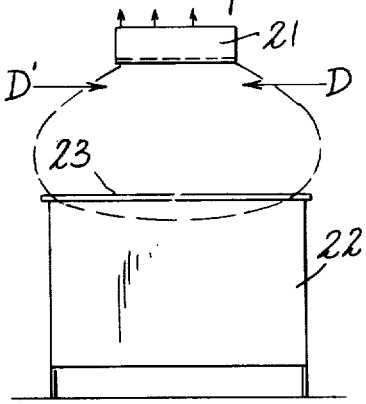
FIG. 4 is a side view of the work station of FIG. 3.

As illustrated in FIGS. 3 and 4, I have discovered that by orienting a refractor plate in a particular manner, a bat wing configuration of luminous flux may be utilized more effectively while reducing direct glare and veiling reflections. With reference to FIGS. 3 and 4, it will be noted that the half bat wing configurations of luminous flux 26 and 27 are directed to the right and left of an operator who may be seated at the desk 22 in a position to view the work surface 23 from a first direction, D or D'. This orientation of the refractor plate thus retains the advantage depicted in FIGS. 1 and 2, namely, illumination of the task 23 but with minimization of glare reflected therefrom.

Figure 5:
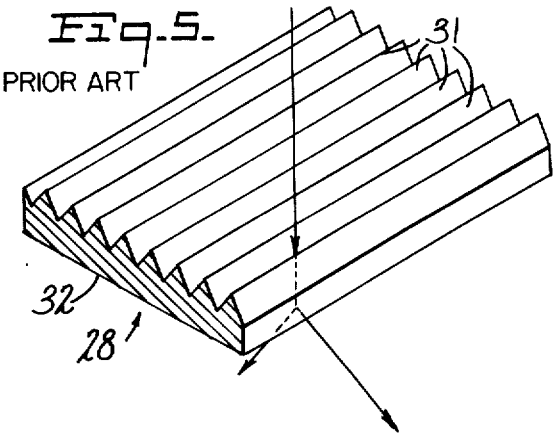
Fig. 5 PRIOR ART
FIGS. 5 and 6 are enlarged, isometric views of available refractor plates which may be used in lighting fixtures of the invention.
Figure 6:
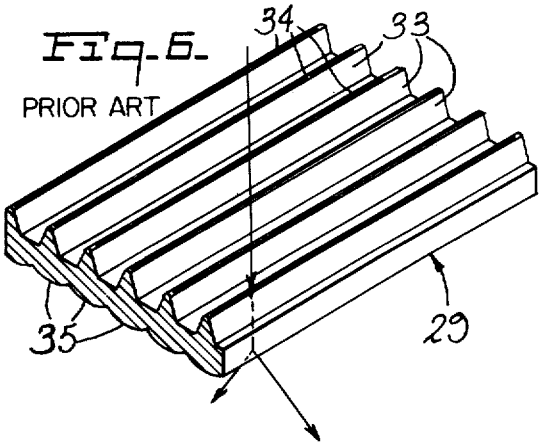
Fig. 6 PRIOR ART

Typical refractor plates utilized in fixtures of the invention are shown in FIGS. 5 and 6. The refractor plate of FIG. 5 is described more fully in U.S. Pat. No. 3,258,590 — Goodbar, issued June 28, 1966. The refractor plate of FIG. 6 is sold commercially as "K-S-H 701 Lensmatic" lens. Each plate is characterized by a plurality of parallel, symmetrical, rib-like prismatic elements defining the light flux receiving surface. In the plate of FIG. 5, these prismatic elements 31 are constructed on an essentially planar bottom surface 32 which defines the light flux emergent surface. The refractor plate 29 of FIG. 6 is similar except that the prismatic elements 33 defining the light flux receiving surface have somewhat flattened apexes 34 which are coated with an opaque material. The emergent surface of plate 29 has a plurality of semi-rounded or scalloped surfaces 35, in contrast to the essentially planar surface 32 of plate 28. Each of the refractor plates 28 and 29 are usually manufactured on an essentially transparent material such as glass or acrylic plastic, and will disperse a ray of impinging light in opposite directions, as illustrated, to form the characteristic bat wing configurations when analyzed photometrically. Similar functioning refractor plates may also be employed.

Figure 7:
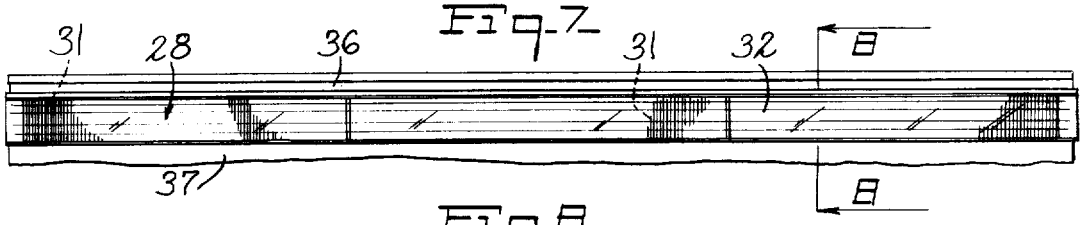
FIG. 7 is an elevational view of a lighting fixture of the invention together with a portion of a cabinet shelf and facia.
Figure 8:
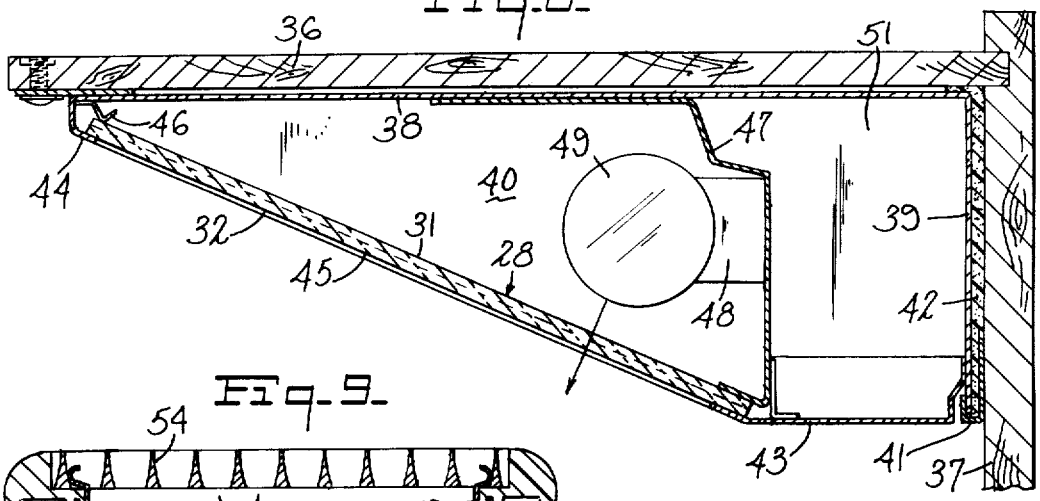
FIG. 8 is a sectional view along the line 8—8 of FIG. 7.

FIGS. 7–11 illustrate several embodiments of lighting fixtures of the invention, incorporating refractor plates such as plates 28 or 29 in the critical orientation of the invention. The fixture of FIGS. 7 and 8 is typical of such fixtures used in cabinets, consoles, wardrobes or under shelves in a bookcase, display case or work area where it is unnecessary or undesirable to illuminate the environment above sitting or standing eye height. The fixture of FIGS. 7 and 8 may be described as a cornice unit designed to fit under a shelf 36 against a vertical wall or a cabinet facia 37. The fixture itself is elongated and comprises a top wall 38, a back wall 39 and a pair of opposing end walls 40. A U-shaped bracket 41 supports back wall 39 and also a panel 42 of heat and electrical insulating material. A bottom wall 43 and an upper elongated bracket member 44 define an opening 45 for luminous flux. A standoff bracket 48 supports a linear light source 49 such as a fluorescent tube. It will be noted that refractor plate 28 is oriented relative to light source 49 such that its rib-like prismatic elements 31 face light source 49 but transversely of the longitudinal axis of the light source, which extends in a second direction $D_2$. It is by this orientation that the half bat wing configurations of luminous flux provided by plate 28 are directed to the right and left of a worker who transversely faces the elongated light source, from the first direction D or D', as previously described with reference to FIGS. 3 and 4. Back wall 39 and intermediate elongated panel 47, the latter also being known as a reflector wire way cover, define therebetween a chamber 51 for wiring, ballast and other known light source equipment.

Figure 9:
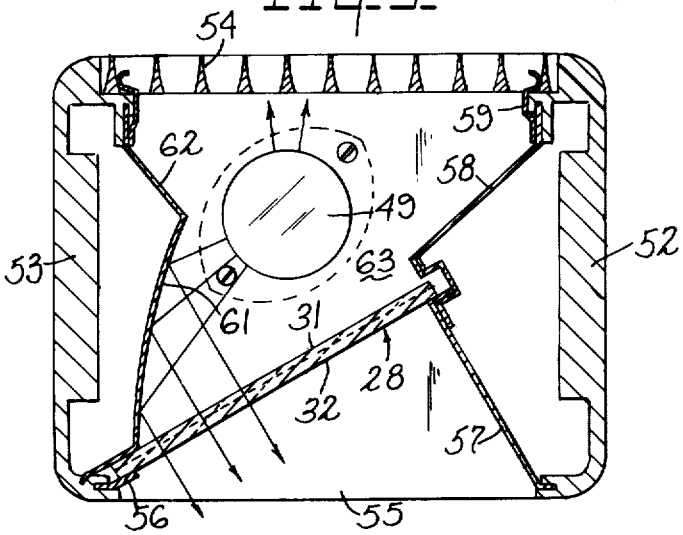
FIG. 9 is a sectional view of another embodiment of a lighting fixture of the invention.

In another embodiment of lighting fixture of the invention, illustrated in FIG. 9, auxiliary reflectors and louvers are provided for even greater efficiency of lighting. With respect thereto, the fixture includes an elongated front wall 52, an elongated back wall 53, and a louvered top member 54 preferably constructed of a specular material such as silver-coated acrylic plastic. The louvered member permits illumination of the work station environment above the fixture, such as adjacent walls and ceiling without visible brightness from normal viewing angles. The bottom of the fixture has an opening 55 defined by a bracket 56 and an elongated bracket cut-off shield member 57. A refractor plate such as plate 28 is mounted between brackets 56 and 57 with its rib-like prismatic elements 31 oriented towards and transversely of, the longitudinal axis of source 49. An upper portion 58 of bracket 57 is provided with a reflective surface and is mounted within the housing. A clip 59 holds the member 54 in place. The refractor plate 28 distributes the light in a bat wing configuration when the light rays impinge thereon, and a parabolic reflector 61 may be arranged relative to linear light source 49 to reflect the light directionally. An upper angled portion 62 of the reflector assists in directing luminous flux from light source 49 through the openings of louver member 54. End walls 63 enclose the structural elements described.

The lighting fixture of FIG. 9 is especially adapted for mounting on or in office partitions and above desks. The lighting fixture also provides considerable illumination through the openings of louver member 54 above and around the work station. In fact about 50 to 75% of the luminous flux is directed upwardly. Of course, by use of suitable reflectors within the housing, a greater proportion of the luminous flux may be directed downwardly and outwardly towards the working surface and environment.

Figure 10:
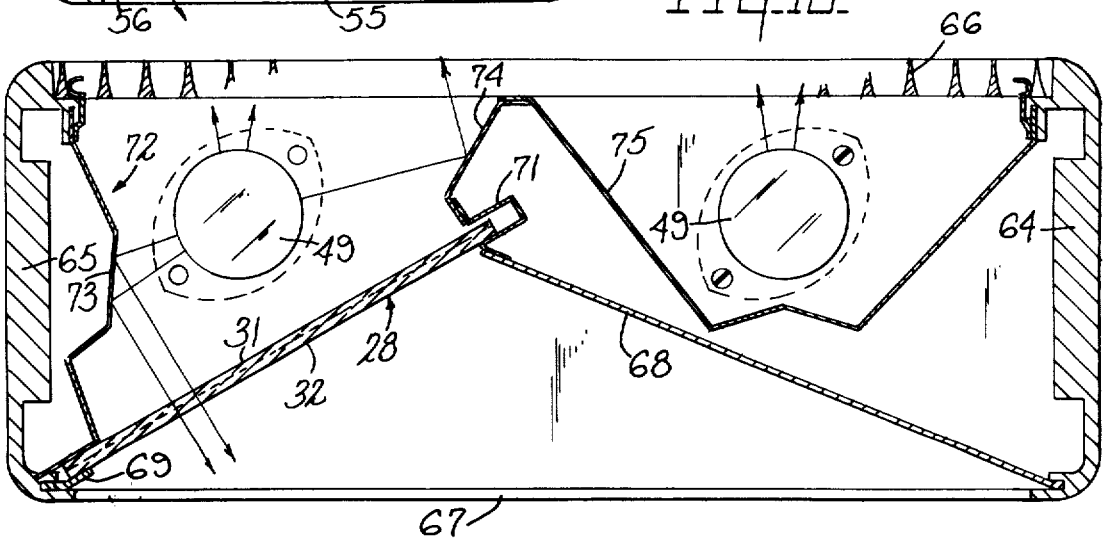
FIG. 10 is a sectional view of still another embodiment of a lighting fixture of the invention.

In still another embodiment of lighting fixture of the invention shown in FIG. 10, a plurality of linear light sources 49 may be employed, for example, when it is necessary to provide greater illumination of the environment such as ceilings and walls. In the fixture of FIG. 10, an elongated front wall 64 and an elongated back wall 65 are capped by louvered top member 66 of specular material. A bottom opening 67 is defined by the lower extremities of an elongated cut-off shield plate 68 and a bracket 69. The upper end of the tilted refractor plate 28 is positioned by a clip 71. An angled, elongated auxiliary reflector plate 72 maintains the lower end of plate 28 in position while at the same time providing at least one parabolic reflector portion 73 for directing luminous flux perpendicularly to the receiving surface of plate 28, so as to project light emerging from plate 28 to the far side of the desk and its side run off or return. Plate 28 is oriented to light source 49 essentially as described with reference to FIG. 9. An upper reflecting portion of reflector plate 72 assists in directing luminous flux upwardly through the openings of louver member 66, as also does a second, auxiliary reflective surface 74.

A second linear lighting source 49, positioned generally parallel to the first light source, is mounted above a W-shaped reflector 75 which directs essentially all of the luminous flux therefrom upwardly through the openings of louver member 66. This lighting fixture therefore efficiently serves the dual purpose of illuminating a work surface below and adjacent the fixture, and the environment above and around the fixture. The fixture therefore will be eminently suited for a desk where ceiling lighting is desired.

Figure 11:
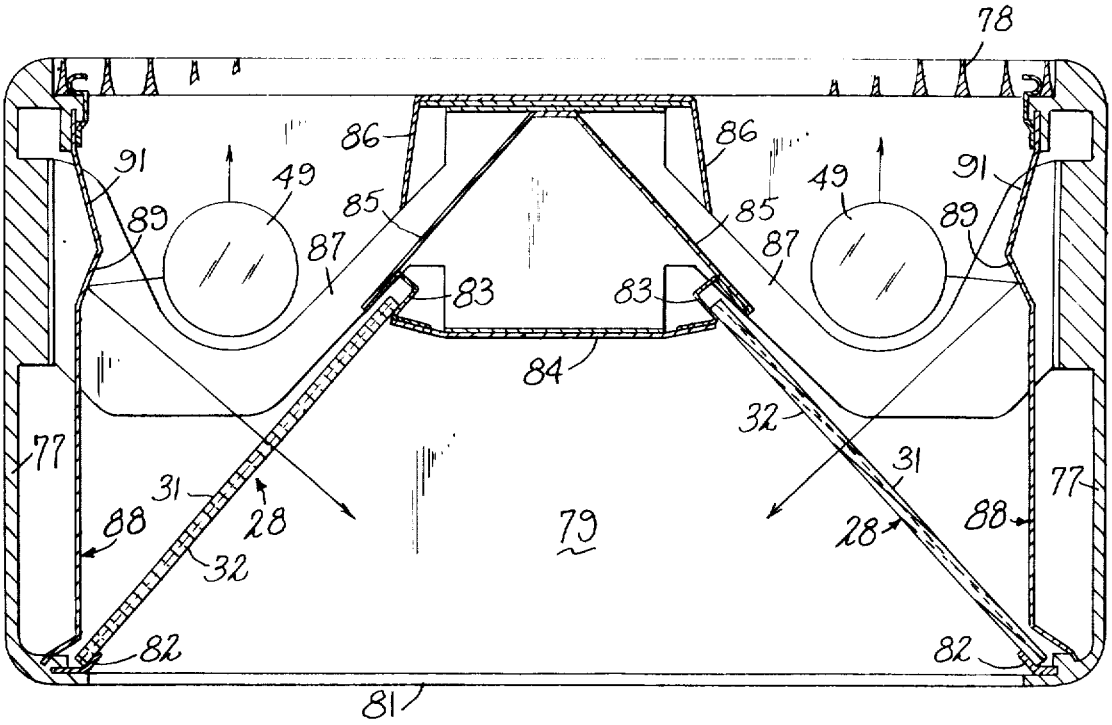
FIG. 11 is a sectional view of yet another embodiment of a lighting fixture.
Figure 12:
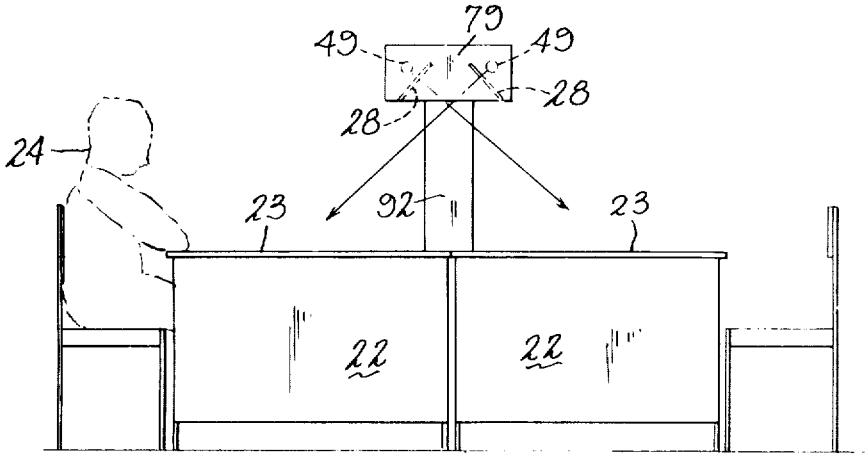
FIG. 12 is a diagrammatic side view showing a mounting position of the lighting fixture of FIG. 11.

A lighting fixture useful for mounting over contiguous work surfaces is illustrated in FIGS. 11 and 12. With reference thereto, the housing of the fixture comprises elongated opposing walls 77 capped by a louvered member 78 of suitable specular material, and end walls 79. The bottom of the housing has an opening 81 defined by clips 82 and 83 supporting a pair of refractor plates 28. Plates 28 are tilted towards each other, and are held at their upper ends by U-shaped clips 83 on a bridging elongated, auxiliary member 84. Similar auxiliary reflective surfaces 85 connect clips 83 to suitable supporting structure below louver member 78, including a U-shaped reflecting cover member 86.

A pair of stiffening members 87 help to position the various reflecting surfaces within the housing. Other reflecting surfaces 88 and 89 assist in efficient directing of luminous flux from light sources 49 through plates 28. The upper portions 91 of the reflecting surfaces may be angled for directing luminous flux upwardly towards the openings of louver member 78, if desired.

Because of the orientation of refractor plates 28 with respect to sources 49 essentially as described with reference to FIGS. 7–10, it will be noted, as shown in FIG. 12, that the luminous flux therefrom will be directed in a crossover manner towards tasks 23 on back-to-back desks 22, by suitable mounting of the fixture on a vertical member 92.

Such fixtures are therefore adapted for illumination of multiple work stations, such as desks placed back to back. The advantage of this arrangement, of course, is that an office area may be illuminated with fewer fixtures than otherwise possible. These and other fixtures of the invention therefore contribute greatly to improvement of working conditions and flexibility of work station arrangements while at the same time providing good illumination at the lowest possible cost.

Another aspect of the invention concerns the tilt of the refractor plates 28 and 29 utilized in the fixtures of the invention. Since I prefer to mount the fixtures in front of and slightly above the eyes, in seated position, rather than to mount the fixture overhead, the refractor plates preferably are tilted within the fixture housings at an angle of from about 0° to about 90° from the horizontal, more preferably about 10°–70°. The extent of tilt will depend on how close the fixture is located to the eyes of a worker, the design of the reflector, etc. The tilt will be smaller if the fixture must be mounted close to the eyes.

The refractor plates of the invention, such as plates 28 and 29, may be of continuous construction or the plates may comprise a plurality of small size units which are mounted adjacent one another such that the rib-like prismatic elements thereof are all positioned transversely of the longitudinal axis of the light source.

As indicated, mounting heights of fixtures of the invention will be about seated eye height to standing eye height.

Light sources for use with the fixtures of the invention include any sources which will emit luminous vlux longitudinally of the fixture housing. While unit elongated or linear sources such as fluorescent tubes are preferred, the longitudinal illumination may be provided also by longitudinally aligning a plurality of light sources which individually have small dimensions. For example, the light source could comprise a plurality of incandescent light bulbs, mercury vapor lamps, or the like, longitudinally aligned within the housing.

In view of the foregoing description it will be apparent that the invention is not limited to the specific details set forth therein for the purposes of illustration, and that various other modifications are equivalent for the stated and illustrated functions without departing from the spirit and scope of the invention.

What is claimed is:

1. In combination: a substantially horizontally disposed work surface spaced from ground level and adapted to be viewed primarily from a first direction, and a lighting fixture arranged above said work surface and means supporting said fixture at a height not substantially lower than the eye level of a person facing said work surface in a position to work thereon, and not at a height substantially above eye height of a person standing adjacent thereto, said lighting fixture including a linear light source having a horizontal axis extending in a second direction perpendicular to that from which said surface is to be viewed and also including an elongated refractor, said refractor having light incident and emergent surfaces and at least one of said surfaces having linear prisms repeating continuously beneath said light source, said prisms oriented substantially perpendicular to said axis and lying in vertical planes substantially parallel to said first direction for receiving incident light from the linear light source and for redirecting light rays emitted by said light source to and through the emergent surface substantially to the right and left of the first direction such that direct glare of the light from the light source and veiling reflections from the work surface directed toward a person facing the light source from said first direction are minimized and substantially eliminated.

2. The combination according to claim 1 wherein the orientation of said prisms is such as to redirect light rays from the light source in a full bat wing configuration.

3. An elongated lighting fixture for illuminating upwardly facing horizontal surfaces spaced from ground level and adapted to be viewed by a person facing said work surface in a position to work thereon with a minimum of direct discomfort glare in directions substantially perpendicular to the longitudinal axis of the fixture, comprising a linear light source having a horizontal axis, an elongated refractor extending beneath and parallel to the axis of said light source, said refractor having light incident and emergent surfaces, and at least one of said surfaces having linear prisms repeating continuously beneath said light source, said prisms oriented substantially perpendicular to said axis for receiving incident light from the linear light source and for redirecting light rays emitted by said light source to and through the emergent surface substantially to the right and left of the directions substantially perpendicular to the longitudinal axis of the fixture such that direct glare of the light from the light source and veiling reflections from the work surface are minimized and substantially eliminated in directions substantially perpendicular to the longitudinal axis of the fixture and means supporting said fixture at a height not substantially lower than the eye level of a person facing said work surface in a position to work thereon and not at a height substantially above eye height of a person standing adjacent thereto.

4. A lighting fixture according to claim 3 wherein said refractor is substantially planar and is tilted laterally about 10° – 90° from the horizontal.

5. A lighting fixture according to claim 3 which includes at least one baffle member arranged to reflect light to said refractor.

6. A lighting fixture according to claim 3 which includes means for permitting the exit from said fixture of luminous flux in a direction away from said refractor.

7. A lighting fixture according to claim 3 which includes a second linear light source, means mounting said second source adjacent and parallel to the first light source and means for permitting the upward exit from said fixture of luminous flux from each of said light source.

8. A lighting fixture according to claim 7 which includes a second elongated refractor extending beneath and parallel to said second light source, said second refractor being identical with the first refractor and said refractors being tilted laterally about 10° – 70° from the horizontal in directions to make the planes of their respective emergent surfaces lie at angles less than about 160°, whereby the luminous flux distributed by each refractor is directed to the region generally below the other refractor.

9. A lighting fixture according to claim 7 which includes at least one baffle member positioned to reflect the luminous flux from said second light source upwardly to said means for permitting the upward exit of luminous flux.

* * * * *